United States Patent [19]

Jones et al.

[11] 4,136,485

[45] Jan. 30, 1979

[54] MINIATURE VEHICLE

[75] Inventors: Lawrence T. Jones, Playa del Rey; Anson Sims, Northridge; Ashley G. Howden, Los Angeles, all of Calif.

[73] Assignee: California R&D Center, Culver City, Calif.

[21] Appl. No.: 748,871

[22] Filed: Dec. 9, 1976

[51] Int. Cl.[2] ..... A63H 29/22

[52] U.S. Cl. ..... 46/251; 46/257

[58] Field of Search ..... 46/250–253, 46/262, 257

[56] References Cited

U.S. PATENT DOCUMENTS

| | | | |
|---|---|---|---|
| 3,159,109 | 12/1964 | Braverman | 46/251 |
| 3,307,292 | 3/1967 | Fileger | 46/257 |
| 3,618,258 | 11/1971 | Clark | 46/257 |
| 3,646,706 | 3/1972 | Adickes | 46/221 |

*Primary Examiner*—Louis G. Mancene
*Assistant Examiner*—Robert F. Cutting
*Attorney, Agent, or Firm*—Jackson & Jones Law Corporation

[57] ABSTRACT

A toy vehicle including a chassis member mounting an electric motor and rear wheels driven by the motor is provided. A unitary steering block is pivotally and floatably mounted at a hitching point on the front of the chassis and bears the vehicle front wheels and receptacles for floatably mounting electrical pickups. Mounted within the pick-ups are small springs which insure electrical contact to the track.

6 Claims, 7 Drawing Figures

FIG. 1
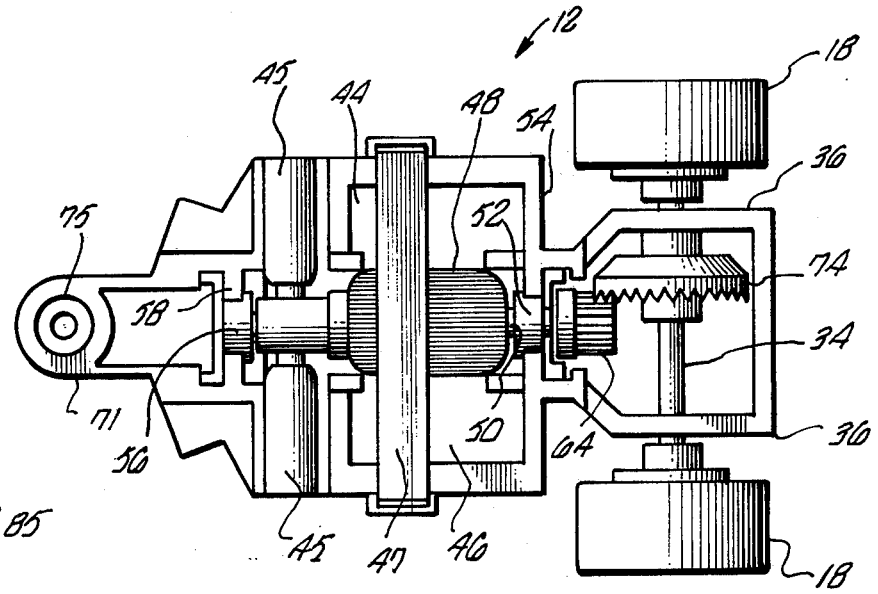
FIG. 6
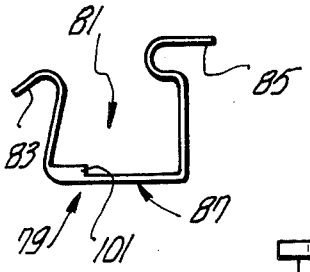
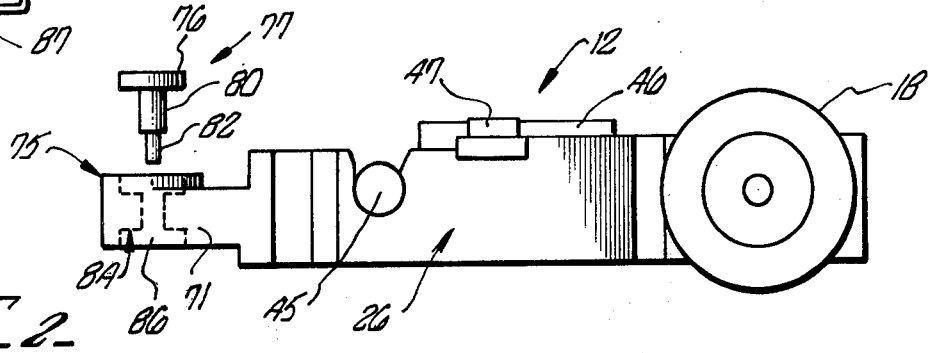
FIG. 2
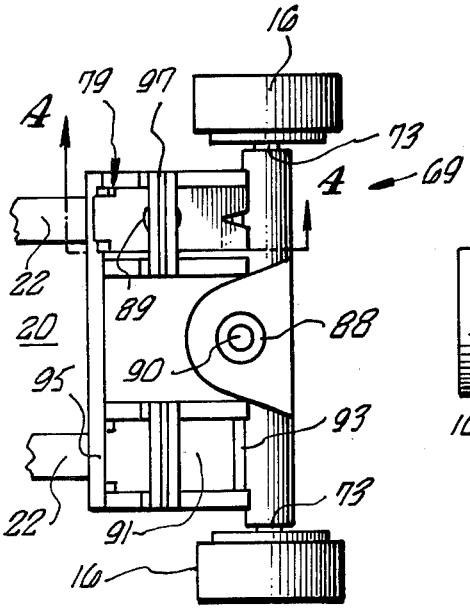
FIG. 3
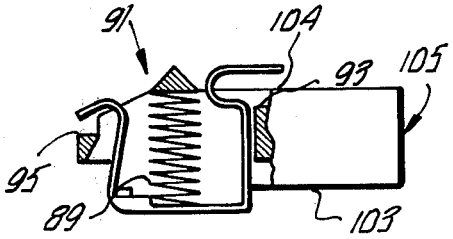
FIG. 4
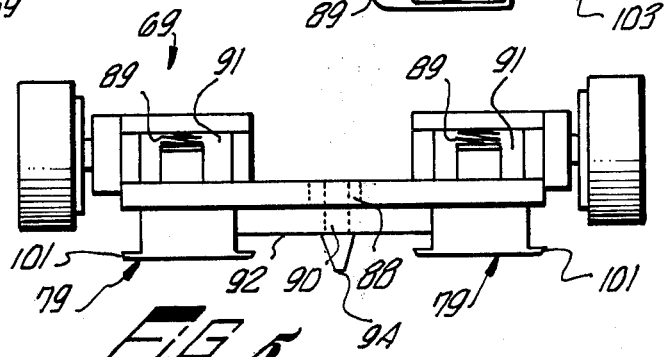
FIG. 5
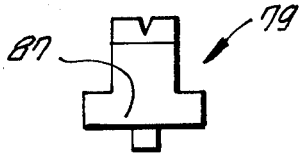
FIG. 7

MINIATURE VEHICLE

BACKGROUND OF THE INVENTION

The present invention relates generally to miniature, electrically powered vehicles which are traditionally used as toys in association with a continuous track which has at least one pair of electric rails associated with it. The vehicle has electrical contacts which engage the pair of rails, thereby delivering electric power to the motor of the vehicle. Such cars are depicted in prior patents including, for example, U.S. Pat. Nos. 3,086,319 to M. G. Frisbie et al and 2,690,626 to G. R. Gay et al.

In many vehicles of this type, the four wheels are mounted to a rigid frame and a guide pin or other protrusion is provided at the forward end of the car, extending down below the level of the front wheels of the car. The guide pin is engaged within a guide slot in the track, and electrical pick-ups are fixed on either side of the guide pin in the car in order to make sliding electrical contact with the rails as the car moves around the track. The track may have several such slots so that several cars can be operated at the same time.

In some instances, such cars operate without a guide pin and the tracks they operate on are provided with multiple pairs of electrical rails such that the electrical pick-ups are substantially continuously engaged with one or another pair of rails along the width of the track. Such products are shown, for example, in U.S. Pat. No. 3,486,271 to R. Feikemer.

Although products of this general type have been successfully manufactured and marketed, there have been a number of problems which have long existed but which have not heretofore been fully solved. Among the most significant of these problems is the insufficient traction force which has allowed the wheels of such electrically powered vehicles to needlessly spin on attempted acceleration and to thereby lose a great deal of their speed. Another serious problem is that of spinning out on curves as a result of the necessarily low weight of the toy cars. These problems have been reduced by the use of larger rear tires of soft material such as foam, plastic or rubber, as opposed to the harder rubber-like tires which had been used. Although the soft and wide tires have produced some improvement in operation of the cars, the low traction and spin problems have continued.

It has been clear to those skilled in this art that increasing the weight of the vehicle would increase the normal force of a vehicle against the track, thereby increasing the frictional forces of traction forces between the vehicle wheels and the track surface. However, the simple expedient of adding weight to the toy vehicle is an unsuccessful alternative because for each increment of additional weight added to the vehicle, one must add additional motive power, i.e., it is required to provide a bigger and/or stronger motor. Not only does this requirement increase the cost of the end product, it is often impossible to obtain any substantial increase in the power of the motor because of the extremely small size of the vehicles, which, in their preferred embodiments are approximately HO gauge.

It has also been known that one could increase the normal force exerted by a car riding upon an iron or steel surface by mounting permanent magnets on the car at a location close enough to the surface such that magnetic attraction would increase the effective normal force on the car. This expedient, however, has never proved successful because the weight of magnets which are effective when displaced from the track pose the same need for increased power as was required for normal weight increases, and the cost of additional magnetic material exceeds the benefit derived in the toy vehicle designs of the prior art. In general, a design providing improved steering performance has been elusive.

SUMMARY OF THE INVENTION

It is among the objects of the present invention to provide an improved electrically operated miniature toy vehicle. Generally, it is the intention of the present invention to provide an improved toy vehicle for use on conventional tracks employing electrical conductors along the paths of travel. More particularly, it is a major object of the present invention to provide an improved electrically operated toy vehicle with a simplified and effective steering mechanism for increasing the traction and spin performance of the vehicle without requiring additional engine power.

These and other objects and advantages are achieved according to the invention by an improved pivotally and floatably mounted steering mechanism. The steering mechanism employs a steering block articulated from a chassis hitch. The block mounts the wheels and the electrical contact elements of the toy vehicle. Bias means associated with the contact elements provide effective contact to the track rails and in combination with the floating steering block provide a positive and realistic steering of the vehicle, permitting sliding of the rear without disengagement from the track.

BRIEF DESCRIPTION OF THE DRAWINGS

The preferred embodiment and best mode presently contemplated for implementing the just summarized invention will now be described in detail in conjunction with the drawings of which:

FIG. 1 is a top view of the chassis of a miniature vehicle in accordance with the preferred embodiment.

FIG. 2 is a side view of the chassis shown in FIG. 1.

FIG. 3 is a top view of the steering block of the preferred embodiment.

FIG. 4 is a sectional view taken along the line 4—4 of FIG. 2 illustrating the floatation of a pick-up in the steering block.

FIG. 5 is a front view of the steering block of the preferred embodiment.

FIG. 6 illustrates a side view of an electrical pick-up used in the steering block of the preferred embodiment.

FIG. 7 is a view of the track-engaging face of the pick-up shoe of FIG. 6.

DETAILED DESCRIPTION OF THE PREFERRED EMBODIMENT

Referring now generally to the drawings, there is shown a toy vehicle which comprises a chassis assembly 12 (FIG. 1) onto which is fitted a steering block 69 (FIG. 3). A toy car body of a desired style may be fitted over the chassis and steering block assembly. The car rides on front wheels 16 and rear wheels 18 on a track 20, the surface of which is interrupted by a pair of electrically conductive rails 22 (FIG. 3). The chassis 12 of the car includes a main frame 26 onto which are mounted the other elements of the chassis 12.

The rear wheels 18, which are of a wide configuration and covered with foam material which has a high coefficient of friction, are mounted on a rear axle 34. The rear axle 34 is journaled in a pair of rearwardly extending bosses 36.

The armature assembly 48 (FIG. 1) and the stationary magnets 44, 46 combine to form the main elements of the electric motor which drives the vehicle. The motor magnets 44, 46 are loosely mounted within the main frame 26 and held by a retaining clip 47. The motor armature assembly 48 and its armature shaft 50 are mounted for rotational movement in the chassis 12. The rear end of the armature shaft 50 rides in a bearing 52 in a cross member 54 of the main frame 26. The front end of the shaft 50 rides in a bearing opening 56 in a front cross member 58. Suitable brushes 45 provide energy to the armature 48.

The drive train from the motor extends through the shaft 50 to a pinion gear 64 which is fixed to the shaft 50 outside of the rear cross member 54. The pinion gear engages a crown gear 74 which, in turn, is fixed to and drives the rear axle 34. Thus, upon rotation of the armature 48, the pinion gear 64 is driven at a relatively high speed and that speed is geared down by passage through the crown gear, delivering rotational power to the rear wheels 18.

The necessary steering and energy pick-up functions are located on an articulated steering block 69, illustrated in more detail in FIGS. 3–5. The steering block 69 appears substantially rectangular in the top view of FIG. 3. From the side, the block 69 resembles a trapezoidal shape with the rear nonparallel side 105 forming a right angle with the two parallel sides 103, 104 of the trapezoid. A wedge shape is formed at the front of the block 69. This wedged-shaped appearance is imparted by two identical pick-up mounting receptacles 91, illustrated in cross section in FIG. 4.

The steering block 69 attaches to a projecting hitch member 71 on the chassis frame 26 and bears wheels 16 simply mounted to rotate on rigid axles 73. The hitch 71 has a cylindrical metal mounting rivet 77. A second, concentric aperture 78 rotatably mounts the pin body 80. The tip 82 of the rivet 77 extends entirely out of the surface 84 of a concentric aperture 86 at the bottom side of the hitch 71. This aperture 86 rotatably receives a portion of a mounting cylinder 88 on the steering block 69.

A final cylindrical aperture 90 receives the tip 82 of the rivet 77. The tip 82 of the rivet 77 is then flattened against the undersurface 92 (FIG. 5) of the steering block 69 to attach the block 69 to the chassis 12.

The outside diameter of the mounting cylinder 88 is such that there is some play when the cylinder 88 is fitted in the aperture 86. Since there is some play in the vertical movement of the rivet 77, the steering block is mounted with a degree of flotation, which aids steering performance.

The front portion of the steering block 69 mounts a guide pin 94 and contains two identical mounting receptacles 91 for receiving identical pick-up shoes 79, illustrated in more detail in FIG. 6 and FIG. 7. The top view of FIG. 3 illustrates one receptacle with a pick-up shoe therein and one without a pick-up shoe.

Each pick-up shoe 79 is cup-shaped in cross section, having a retaining cavity 81 formed therein and retaining tangs 83, 85 at the front and rear. The track contact portions 87 of the pick-ups 79 are T-shaped (FIG. 7), and have a lip 101 formed around the edge of the cross portion of the "T". Each retaining cavity 81 may thus contain a small spring 89 (FIG. 4) entirely separated from any track contact by the width of the "T" shaped pick-up shoe face 87. Appropriate leads may be soldered to each shoe to deliver current to the motor brushes 45.

Each pick-up 79 rides loosely in a mounting receptacle 91, biased to the track by a spring 89. The receptacle 91 has a rear projection 93 raised above the front edge 95 of the block 69 such that when the rear tang 85 is flush against the rear projection 93 and the front tang 83 is flush against the front edge 95, the pick-up face 87 is substantially parallel to the undersurface 103 of the steering block 69. A bar 97 is provided over each receptacle 91 to retain a spring 89 and limit upward movement of a shoe 79 in a receptacle 91. Downward movement is limited by the tangs 83, 85. The tangs 83, 85 may initially be formed vertically and then bent into position to facilitate mounting them in the receptacles 91.

Thus, each shoe 79 is free to float with respect to the steering block 69. The walls of the pick-up cavity 81, the bar 97, the lip 101 and the mounting receptacle structure retain the springs 89. The springs insure positive electrical contact despite the articulated nature of the steering block. Flexibility is added to the steering mechanism by the ability of the pick-up assemblies to float and the degree of articulation of the steering block.

It should be understood that modifications and adaptations may be made to the above detailed preferred embodiment. Therefore, it is to be understood that, within the scope of the appended claims, the invention may be practiced other than as specifically set forth above.

What is claimed is:

1. In a miniature vehicle for operating on a track containing electrical power conductors and including a chassis, rear wheels and electric drive means for driving said rear wheels, the improvement in steering apparatus interfacing with said conductors comprising:

a substantially triangular hitch section on said chassis;

a unitary steering block mounted to said chassis on said hitch section;

first and second receptacles in said steering block;

first and second front wheels mounted to rotate on said steering block;

first and second electrical conductive pick-up means floatably mounted in said first and second receptacles, respectively, for maintaining electrical contact to said power conductors, and means for biasing each floating pick-up means into said electrical contact with said power conductors.

2. A miniature vehicle for operating on a track containing first and second conducting channels comprising:

a chassis having a triangular hitch section, a rectangular drive section mounting electric propulsion means, and rear wheels activated by said propulsion means;

a unitary steering block pivotally and floatably attached to said hitch section;

first and second front wheels rotatably mounted at either side of said steering block;

first and second receptacle apertures in said steering block, each having a back surface stepped above a front surface;

first and second cup-shaped conductor shoes each having a rear tang raised above a front tang, said rear tang resting on said back surface and said front tang resting on said front surface of a respective receptacle aperture; and means fitted into the cup of each said first and second conductor shoes for providing positive electrical contact to said channels.

3. A miniature electrically powered vehicle for operation on a track having first and second power conducting channels comprising;

a chassis member;

a hitch member mounted on the chassis member;

rear wheels supported by the chassis member;

an electric motor mounted on the chassis member and operatively connected to the rear wheels for driving the same; and means mounted to the chassis member for delivering power to the electric motor and guiding the chassis member along the track including, a unitary steering block pivotally mounted to the hitch member, a first and second receptacle in the steering block, a pair of front wheels rotatably mounted on the steering block, first and second electrical pick-up means floatably mounted in respectively the first and second receptacles for contacting respectively the first and second power conducting channels, each pick-up means comprises a cup-shaped electrically conductive member having a T-shaped contact portion and an upper tang and a lower tang contacting the steering block adjacent the receptacles and a first and second spring dimensioned to fit into the respective cups for biasing the first and second electrical pick-up means against their respective power conducting channels.

4. A miniature electrically powered vehicle for operation on a track having first and second power conducting channels comprising;

a chassis member;

a hitch member mounted on the chassis member;

rear wheels supported by the chassis member;

an electric motor mounted on the chassis member and operatively connected to the rear wheels for driving the same; and means pivotally mounted to the chassis member for delivering power to the electric motor and guiding the chassis member along the track including, a unitary steering block pivotally mounted to the hitch member, a first and second receptacle in the steering block, a pair of front wheels rotatably mounted on the steering block, first and second electrical pick-up means floatably mounted in respectively the first and second receptacles for contacting respectively the first and second power conducting channels and means for biasing the first and second electrical pick-up means against their respective power conducting channels.

5. The invention of claim 4 wherein each said electrical pick-up means comprising a substantially U-shaped member having a first and second tang portion at its top and a lower T-shaped contact portion, said tangs extending beyond said receptacles to limit downward vertical movement and said means for biasing includes a first and second spring mounted within each receptacle to contact said U-shaped member between its respective tangs.

6. The invention of claim 5 further including a bar member extending across each receptacle to limit upward vertical movement of said pick-up means and further to mount one end of said spring.

* * * * *